United States Patent [19]

Miller

[11] 4,183,507

[45] Jan. 15, 1980

[54] SYSTEM FOR INTRODUCING ADDITION AGENTS INTO VESSEL OF MOLTEN METAL

[75] Inventor: Eldon D. Miller, Zelienople, Pa.

[73] Assignee: Lava Crucible Refractories Co., Pittsburgh, Pa.

[21] Appl. No.: 923,952

[22] Filed: Jul. 12, 1978

[51] Int. Cl.[2] ..... C21C 7/00

[52] U.S. Cl. ..... 266/216; 75/61; 75/53; 75/93 A

[58] Field of Search ..... 75/53–58, 75/61, 93 R, 93 A, 93 AB, 93 AC, 93 AD, 93 DA; 266/216

[56] References Cited

U.S. PATENT DOCUMENTS

| | | | |
|---|---|---|---|
| 165,929 | 7/1875 | Hudson | 266/216 |
| 1,938,716 | 12/1933 | Norris | 266/216 |
| 2,698,749 | 1/1955 | Fishell | 75/58 |
| 2,982,535 | 5/1961 | Hiskey et al. | 266/216 |
| 3,255,898 | 6/1966 | Carli et al. | 75/61 |
| 4,093,452 | 6/1978 | Spenceley et al. | 75/93 R |

*Primary Examiner*—Gerald A. Dost

*Attorney, Agent, or Firm*—Webb, Burden, Robinson & Webb

[57] ABSTRACT

A system for treating molten metal with addition agents comprising a refractory lined vessel containing the molten metal and a vehicle movable relative to said vessel having associated therewith a cylinder terminating in an extrusion die. The refractory lined vessel has an addition agent port in the base which may be stopped and unstopped. The cylinder is provided with means for engaging the addition agent port on the vessel and communicating therewith. The cylinder is provided with means for advancing extrudable addition agent through the die. When the port is stopped, the vehicle can be brought near the vessel, and the cylinder connected to the port and when the port is unstopped the cylinder may be discharged through the die introducing additive agent into the bottom of the vessel.

3 Claims, 3 Drawing Figures

SYSTEM FOR INTRODUCING ADDITION AGENTS INTO VESSEL OF MOLTEN METAL

BACKGROUND

In the past, systems have been proposed for introducing addition agents into vessels and/or ladles through the bottom thereof. However, no such systems are known to be in current use. One ancient patent suggests apparatus for introducing a small one shot charge of finely divided material into the bottom of the container of molten metal (See U.S. Pat. No. 165,929). Yet another very old patent suggests extruding metallic sodium or other metals soft enough to be extruded into the bottom of a ladle (See U.S. Pat. No. 1,938,716). A recent patent suggests carrying gas entrained addition agents through the bottom of the vessel (See U.S. Pat. No. 3,980,469). None of the prior art patents provide for the introduction of large quantities of addition agents without the use of an inert gas carrier which may create substantial dust pollution in the vicinity of the vessel as it emerges from the bath.

Filed of even date herewith are two patent applications Application Ser. No. 924,079 entitled "Method of Introducing Addition Agents Into a Vessel of Molten Metal" and Application Ser. No. 924,080 entitled "Method of Introducing Calcium and Calcium Alloys Into Molten Metal." The system and/or the apparatus disclosed herein are particularly suitable for practicing those methods.

SUMMARY OF THE INVENTION

This invention relates to a system for treating molten metal with addition agents. The system comprises a refractory lined vessel for containing the molten metal to be treated. The vessel must have a port through the base thereof which may be stopped and unstopped and used for the introduction of addition agents as further described herein. The port most likely is not the same port through which the molten metal is later to be teemed. The system further comprises a vehicle movable relative to said vessel under its own power motivation system, said vehicle carrying a cylinder terminating in an extrusion die at one end. The cylinder is provided with means for permitting the introduction of extrudable addition agent into the cylinder. It is also provided with means, for example a piston or ram, for advancing the extrudable addition agents to the die. Where the ram is hydraulically operated, the vehicle carries a hydraulic system including pumps, reservoirs, conduits and valves. The cylinder also comprises at the die end thereof means for releasably connecting the cylinder to the addition agent port of the vessel or ladle. Typically an elbow at the end of the cylinder is required to change the direction of flow of the addition agent from horizontal to vertical. The system cooperates as follows: When the vessel is brought near, the vehicle can be moved to bring the cylinder into engagement with the port while it is stopped. When the port is unstopped, the additive agent may be extruded through the die and port into the vessel.

Preferably the cylinder is provided with means for heating the cylinder and its contents.

DESCRIPTION OF THE PREFERRED EMBODIMENTS

Figures 1, 2A, 2B:
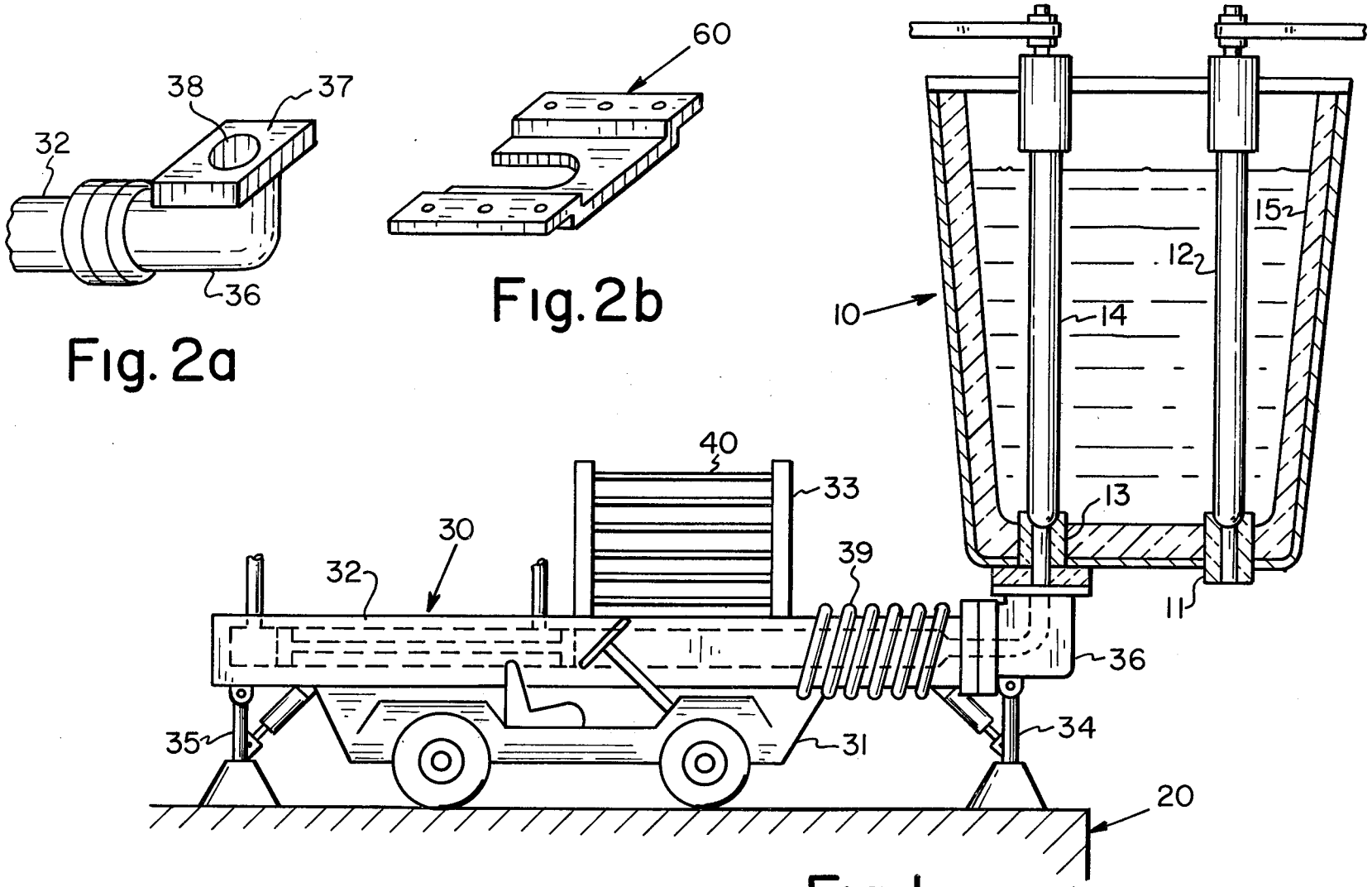

Further features and other objects and advantages of this invention will become apparent from the following detailed description made with reference to the drawings in which FIG. 1 is a partial section of apparatus of the system according to this invention and FIG. 2*a* is a detail perspective of the elbow and flange of the vehicle shown in FIG. 1 and FIG. 2*b* is a detail in perspective of the bracket attached to the base of the vessel shown in FIG. 1.

In most commercial steelmaking shops, steel is drawn from a basic oxygen vessel, electric furnace or open hearth into a teeming ladle. The ladle may then either be teemed into ingot molds in the pouring pit often adjacent a pouring platform or it may be drained into a tundish from which the steel is continuously cast. Common addition agents in the past have been added by tossing bags thereof into the open ladle while it is adjacent the open hearth, for example. The ladle is then moved away as already explained.

This invention has application to any of the above mentioned types of steelmaking, i.e., basic oxygen, open hearth and electric furnace when combined with either the ingot mold casting or continuous casting processes. In fact, it may even have application for use in nonferrous metallurgy, for example, in the deoxidation of copper. With reference to the traditional open hearth shop, according to this invention there is provided a vehicle movable about the teeming platform adjacent the track on which the mold cars carrying the ingot molds run. A vehicle carries a piston and cylinder for forcing addition agents through the bottom of the teeming ladle when it is moved near the pouring platform. In the case of continuous casting, the vehicle is located to be moved subjacent the transfer ladle before it is raised high above the ground to discharge into the tundish ladle. In the case of electric furnace steels and specialty steels made in small batches, the vehicle is located in the vicinity of the pouring pit. The mobility of the vehicle provides flexibility in that the vehicle and associated piston and cylinder can be brought into association with one or more selected ladles one at a time. The mobility of the vehicle provides a capability of putting the vehicle out of the way when it is not being used. The ladles useful in the system according to this invention must not only have a stoppable teeming nozzle but a stoppable port in the bottom of the vessel to which the piston and cylinder may be secured.

Referring now to the drawing, there is shown a refractory ladle 10, positioned by a crane (not shown) adjacent the pouring platform 20. A movable vehicle 30 is positioned upon the platform in the vicinity of the ladle.

The ladle has a pouring nozzle 11 that is controlled by stopper and stopper rod assembly 12. The ladle has another port which is controlled by a second stopper rod assembly 14. The stopper rod assemblies are only partially shown as they are well known in the teeming art. The ladle is provided with an appropriate refractory brick lining 15. While stoppers and stopper rod assemblies have been illustrated for simplicity, those skilled in the art will recognize that slide gates are equally suitable means for controlling the pouring nozzle and the addition agent port 13.

The mobile vehicle may have a chassis with front and rear axles thereon for carrying front and rear wheels, for example, pneumatic tires. At least one axle must be steerable. The vehicle has its own motivating system with appropriate drives for moving the vehicle into position near the vessel. The basic function of the vehicle is to carry the cylinder 32 and the associated hydraulics (i.e., motor, reservoir, conduit and controls not shown). Roughly speaking, the cylinder is divided into three functional sections. The back half comprises a double acting hydraulic cylinder. The piston can be completely withdrawn into the back half of the cylinder. The frontmost quarter of the cylinder comprises an extrusion section terminating in an extrusion die, that is, a reduced section. The centermost portion comprises a loading section, i.e., the cylinder is open on one side to permit the loading of the cylinder with cartridges of extrudable additive agents. Over the loading section is a rack 33 for holding the ready to use cartridges 40 of extrudable additives. Hydraulically positionable stands 34 and 35 are arranged to remove the vehicle load from its suspension system after the cylinder has been connected to the additive agent port 13 of the vessel.

Referring to FIG. *2a*, at the end of the cylinder there is an elbow 36 which is arranged to engage the vessel with its outlet and the additive agent port aligned. The elbow is connected to the cylinder and in this case has a flange 37, through which its outlet opening 38 emerges.

FIG. *2b* illustrates a bracket 60 which is mounted to the base of the ladle. The flange 37 on the upper face of the elbow 36 is sized to slide into the space between the bottom of the ladle and the interior of the bracket 60. In some cases, it is desirable to heat the die and the cylinder 32 and for this reason electrical heating coils 39 are shown in FIG. 1.

Before or after the vehicle is positioned with the cylinder engaging the ladle additive agent port, the piston is withdrawn to its rearwardmost position and a cartridge of extrudable additive agent is positioned in the cylinder. Thereafter the piston is brought forward to move the cartridge into the extruding section of the cylinder and is further advanced to extrude additive through the elbow and into the port of the ladle. At this time, the ladle port is unstopped and the piston continuously extrudes the extrudable additive into the base of the vessel through the the additive agent port. When the piston reaches its extreme position toward the die end of the cylinder, a short period of time is permitted for the extrudable agent to work its way into the solution in the vicinity of the stopper seat. Thereafter, the stopper is allowed to seal the additive agent port and the piston is returned to its rearwardmost position permitting the introduction of an additional cartridge of extrudable addition agent into the cylinder. The process is repeated until sufficient additive agent has been introduced into the melt. When the addition process is complete, the vehicle is withdrawn from the vessel and the vessel is thereafter (in the case of an open hearth shop of the traditional type) teemed into the ingots adjacent the pouring platform through the teeming nozzle.

In a preferred embodiment, the die end of the cylinder is heated by heating elements 39 which may be electrical resistance or induction heating elements of the type well known in the art. In this case, it will be necessary for a flexible cable to connect the vehicle with an electrical power supply.

The embodiment illustrated in FIG. 1, shows a stopper rod assembly for closing the additive port 13. However, the port could very well be closed by a slide gate of the three plate type in which an apertured plate slides between two fixed apertured surfaces. The alignment of the aperture in the movable plate with the other apertures places the elbow in communication with the vessel interior. Preferably, the extrudable addition agent will be forced into the elbow just below the sliding plate. Thus when the gate is opened the molten metal will not rush into the elbow. The piston then extrudes the additive into the vessel. Near the end of the piston stroke the slide gate will be closed while the aperture is filled with the extrudable additive agent. The temperature of the extrudable agent by the time it reaches the slide gate will render it sufficiently plastic that the gate will simply shear the column of additive in order to move the apertures out of alignment.

Having thus defined the invention with the detail and particularity required by the Patent Laws, what is desired protected by Letters Patent is set forth in the following claims.

I claim:

1. A system for treating molten metal with addition agents comprising:

(a) a refractory lined vessel for containing the molten metal, said vessel having a port through the base thereof, and means permanently associated with said vessel for stopping and unstopping the port, (b) a vehicle movable relative to said vessel having associated therewith (i) a cylinder terminating in an extrusion die at one end, (ii) means for permitting the introduction of extrudable addition agents to said cylinder, (iii) means for advancing the extrudable addition agents through the die, (iv) means for releasably connecting the die to the port in said vessel without interfering with said means for stopping and unstopping the port, whereby when the port is stopped the vehicle can be brought near the vessel and the die connected to the port, and when the port is stopped the cylinder may be charged, and when the port is unstopped the addition agents may be extruded through the die and port into the vessel.

2. A system according to claim 1 wherein the cylinder is provided with means for heating the cylinder and its contents.

3. A system according to claim 1 wherein the advancing means is a piston.

* * * * *